United States Patent [19]

Debolt

[11] 4,045,597

[45] Aug. 30, 1977

[54] PROCESS FOR MODIFYING AMORPHOUS CARBON FILAMENTS

[75] Inventor: Harold E. Debolt, Andover, Mass.

[73] Assignee: Avco Corporation, Wilmington, Mass.

[21] Appl. No.: 634,478

[22] Filed: Nov. 24, 1975

Related U.S. Application Data

[63] Continuation-in-part of Ser. No. 230,867, March 1, 1972.

[51] Int. Cl.[2] ..... C23C 11/08; B05D 3/02

[52] U.S. Cl. ..... 427/248 A; 427/52; 427/248 E; 427/248 J; 427/249; 427/372 R; 427/399; 427/402

[58] Field of Search ..... 427/52, 249, 399, 248 E, 427/248 J, 372 R, 314, 402, 248 A

[56] References Cited

U.S. PATENT DOCUMENTS

| | | | |
|---|---|---|---|
| 1,019,569 | 3/1912 | Weintraub | 427/52 X |
| 2,764,510 | 9/1956 | Ziegler | 427/249 X |
| 3,206,331 | 9/1965 | Diefendorf | 427/249 |
| 3,334,967 | 8/1967 | Bourdeau | 427/249 X |
| 3,369,920 | 2/1968 | Bourdeau et al. | 427/372 X |
| 3,778,300 | 12/1973 | Wohlberg | 427/399 X |
| Re. 28,312 | 1/1975 | Basche et al. | 427/52 |

*Primary Examiner*—Harry J. Gwinnell
*Attorney, Agent, or Firm*—Abraham Ogman

[57] ABSTRACT

A filamentary reinforcement product for composites used in applications requiring high strength and high modulus of elasticity materials, particularly under high temperature service conditions, comprising one mil thick or thicker coatings of boron or boron carbide on a substrate which comprises about a one mil diameter carbon substrate having a catalytically transformed skin layer of highly oriented graphite formed from the carbon substrate using a boron catalyst.

7 Claims, No Drawings

PROCESS FOR MODIFYING AMORPHOUS CARBON FILAMENTS

CROSS REFERENCE TO RELATED APPLICATIONS

This application is a continuation-in-part of my co-pending application, Ser. No. 230,867, filed Mar. 1, 1972, RAD 165, the disclosure of which is incorporated herein by reference as though set out at length herein.

BACKGROUND OF THE INVENTION

The present invention relates to filamentary reinforced composites, used in applications requiring high strength and/or high modulus of elasticity materials, particularly for high temperature service, and more particularly to boron reinforced composites.

For some 20 years, there has been intensive development of composites with reinforcements utilizing the high strength and high modulus of elemental boron and to a lesser extent the compound system boron carbide, in the form of filaments made by chemical vapor deposition of the reinforcing material on a substrate. The substrate has been primarily selected from refractory metals, and more particularly tungsten. However, cost and weight penalties of tungsten have compelled considerable effort towards provision of a feasible substitute of lesser density and cost, consistent with the necessary conductivity and strength properties. Carbon monofilaments have been found particularly suitable for this purpose but have not afforded sufficient reliability in production to displace tungsten yet.

One approach is substantially given in U.S. Pat. No. 3,679,475 and references therein cited and in my above cited co-pending application and references therein cited.

It is an important object of the invention to provide filamentary reinforcements comprising boron or boron carbide coating on the carbon substrate which is reliably produceable in long lengths.

It is a further object of the invention to enable coating of such carbon substrates without breakage, particularly with boron layers of at least one mil thick and preferably thicker.

SUMMARY OF THE INVENTION

In the preferred embodiment, a carbon filament of about one mil diameter is treated by flash coating a very thin layer —no greater than 2.5 microns thick and preferably substantially less—of boron thereon and subsequently heat treating the flash coated carbon product at 2,200°-2,800° C, preferably 2,500° C for about two seconds or less, preferably about one second to produce an oriented graphite skin coating by catalytic means. The procedure for producing the flash coating and skin layer may be repeated one or more times. Subsequently, a deposit of high strength, high modulus boron is applied on the so-treated substrate in conventional faashion in a thickness at least equal to the core diameter, or in accordance with the state of the art advances described in my said co-pending application.

It has been discovered that the resultant filaments are less vulnerable to breakage when being coated and can be coated more reliably in longer lengths than in prior art products. The reasons for this advance are not entirely understood, but are believed to comprise, possibly among others, the observable elimination of debris and tars from the substrate which could adversely effect the quality of high strength, high modulus coating material deposited thereon and the development of a skin layer of the carbon substrate which is catalytically converted by the presence of a suitably thin layer of boron to a highly oriented graphitic layer.

This procedure also makes possible a more rapid formation of the oriented graphite skin layer, resulting in a more economic product.

Other objects, features and advantages of the invention will be apparent from the following detailed description of the invention.

DETAILED DESCRIPTION OF THE PREFERRED EMBODIMENTS

Often filament substrates are provided as a product of coat tar pitch produced in accordance with U.S. Pat. No. 3,595,946, granted July 27, 1971 to Joo et al and the improvements thereof described in my co-pending application, entitled "A Carbon Filament Coated with Boron and Method of Making Same," Ser. No. 230,867, filed Mar. 1, 1972, the disclosure and references cited in said patent and application, the disclosures of all of which are incorporated herein by reference as though set out at length herein.

The substrate is passed through a tubular reactor and heated either by passage of electrical current therethrough, or indirectly, to a temperature of 1,100°-1,400° C, and preferably 1,300° C, and an atmosphere of boron trichloride vapor and hydrogen is maintained therein, flowing either co-current or counter current to the direction of movement of the substrate filament which rapidly passes through the reactor with the result that the hot substrate is exposed to the gaseous environment of the reactor for a short period of time to produce a layer of boron essentially uniformly on the substrate in a thickness of about 0.1 - 2.5 microns. This process is called chemical vapor deposition, and, at time, pyrolitic deposition.

With or without an intermediate step of cooling to room temperature, the flash-coated carbon filament is brought up to a temperature of about 2,500° C and passed through a reactor containing an inert environment provided by argon or other inert gas flushing, for a period of about a second. The latter step results in a conductivity rise of at least two times for the flash-coated carbon filament. A skin layer of oriented graphite is produced.

Subsequently, the so-treated carbon filament is passed through a further reactor for chemical vapor desposition of boron in some conventional way, for example, as described in my said application Ser. No. 230,867, first cited above, or U.S. Pat. No. 3,679,475.

The resultant product contains three separate and distinct zones—the amorphous carbon core, the intermediate graphite skin layer, produced by catalytic conversion, and the outer boron coating.

It was found in actual practice of the above described embodiment, and variations of such practice, that the boron catalyst was essential for forming the oriented graphite layer under the time and temperature conditions described above and that the layer would not form without the boron. With the boron catalyst, repeated deposition runs were enabled in which final boron coat layers more than one mil thick could be coated without catastrophic breakage of the carbon substrate. This breakage normally would occur without the boron flash coating and heat treatment as a result of growth strains imposed on the substrate by the final boron coat growth phenomenon. It was also observed that there was lesser tendency with the boron catalyst than without for carbonaceous debris to occur at the entrance of the boron coating reactor. Such debris when it would occur would tend to cause serious flaws in short run lengths in the product.

The following characteristics of treated and non-treated carbon monofilament have been observed. When a carbon monofilament, produced from coal tar pitch, is heated in the range of 1,100–2,500° C, its resistance will drop. However, following the boron flash and graphite skin treatments, the treated monofilament has a resistance per unit of length less than one half as great as the lowest resistance per unit length of the above-mentioned untreated carbon monofilament, i.e., the resistance of the filament with the skin layer as a whole decreases by a factor of at least two times.

More significantly, when a boron coating is deposited on an untreated carbon monofilament, which has been heated above 1,100° C, such as, to 2,500° C, the problem, which the addition of a boron flash cures, persists.

A carbon monofilament that has undergone boron flash and graphite skin treatments contains a visually observable skin layer. The skin layer is definitely not $B_4C$. As $B_4C$ is a semiconductor, it would cause a rise in resistance at room temperature.

There have been indications that small quantities of boron in combination with carbon acts as a catalyst to convert amorphous carbon catalytically to graphite when the amorphous carbon containing a boron is raised to elevated temperatures. The demonstrable drop in resistance noted above is consistent with the development of a highly oriented graphitic skin coating.

The most widely used boron filament has a nominal diameter of 4.0 mils. A nominal 1.3 mil carbon core is used. In practice, the core may vary from 1.0–1.4 mils in diameter.

The graphite skin layer appears to contain some elemental boron and boron in combination with carbon. These inclusions appear in very small amounts and do not materially affect the performance of the graphite skin layer.

Untreated, the 1.3 mil carbon monofilament core has a resistance of about 700 ohms/inch when made. This can be reduced by heating the carbon monofilament above 2,100° C to about 550 ohms/inch.

Typically, a 0.1–2.5 microns flash coating of boron is applied, with 0.1–1 microns being preferred. When the carbon monofilament with boron flash is heated as prescribed, a .02–.05 mil skin layer of oriented graphite is produced. Preferably, the skin layer of graphite should not exceed 0.2 mil.

The aforementioned 0.1–2.5 micron boron flash coating appears to be a narrow window. The procedure deteriorates with heavier boron flash coatings. The preferred procedure is successive flash coatings of 0.1–2.5 microns followed by heat treating to produce thick graphite skin layers, in the order of 0.1–0.2 mil.

The resistance of the 1.3 mil carbon monofilament with a graphitic skin layer is typically in the order of, but generally less than 200 ohms/inch.

It is evident that those skilled in the art, once given the benefit of the foregoing disclosure, may now make numerous other uses and modifications of, and departures from the specific embodiments described herein without departure from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A process for modifying amorphous carbon filament for use as a filamentary reinforcement for composites comprising:

depositing a flash coating or boron on said filament;

subsequently heat treating the flash coated filament at a temperature above 2,100° C in an inert atmosphere for catalytically transforming the amorphous carbon into a skin layer of highly oriented graphite such that the resistance of the filament with the skin layer aas a whole decreases by a factor of at least two times.

2. A process as defined in claim 1 where the boron flash coating is produced by chemical vapor deposition.

3. A process as defined in claim 2 where said chemical vapor deposition takes place at 1,100°–1,400° C.

4. A process as defined in claim 1 wherein:

a. the carbon core has a diameter of 1–1.4 mils; and b. the graphite skin layer is less than 0.2 mil.

5. A process in accordance with claim 1 wherein the boron flash coating is 0.1 to 2.5 microns thick.

6. A process according to claim 1 where the graphite skin layer is produced by repeating the steps in claim 1, one or more times.

7. A process in accordance with claim 1 and comprising a further step of depositing a coating of high strength, high modulus material on the treated filament in a thickness at least equal to the core diameter.

* * * * *